United States Patent [19]

Heinz

[11] 4,224,029

[45] Sep. 23, 1980

[54] EXOTIC LEATHER, METHOD OF PROCESSING SAME, AND METHOD OF PROCESSING DOMESTIC FOWL

[76] Inventor: George G. Heinz, Box 72, Rte. 12, Greenville, S.C. 29609

[21] Appl. No.: 964,129

[22] Filed: Nov. 27, 1978

[51] Int. Cl.[2] ..... C14C 3/00

[52] U.S. Cl. ..... 8/94.19 R; 8/94.1 R; 8/94.15; 8/94.16

[58] Field of Search ..... 8/94.19 R, 94.16, 94.15, 8/94.1 R

[56] References Cited

U.S. PATENT DOCUMENTS

| | | | |
|---|---|---|---|
| 1,969,922 | 8/1934 | Canter | 8/94.15 |
| 2,017,648 | 10/1935 | Bloom et al. | 17/1 D |
| 2,086,920 | 7/1937 | Moore | 8/94.15 |
| 2,102,699 | 12/1937 | Green | 8/94.19 R |
| 2,354,200 | 7/1944 | Cutler | 8/94.19 R |
| 2,525,539 | 10/1950 | Gibson | 8/94.15 |
| 2,937,921 | 5/1960 | Cordon et al. | 8/94.19 R |
| 3,272,585 | 9/1966 | Rafferty et al. | 8/94.14 |
| 3,294,479 | 12/1966 | Rosenbusch | 8/94.15 |
| 3,429,648 | 2/1969 | Langley | 8/94.15 |
| 3,574,517 | 4/1971 | Elvrum | 8/94.15 |

*Primary Examiner*—Ronald W. Griffin
*Attorney, Agent, or Firm*—Bailey, Dority & Flint

[57] ABSTRACT

It has been found that domestic turkeys raised for food processing may be skinned with feathers on for processing the skin into exotic leather having areas or patterns of raised folicles, or puckered portions with such patterned areas themselves displaying an unexpected pattern therein as opposed to a regular or random spacing. The natural puckers are further enhanced by shrinking subsequent to feather removal to raise the pattern while the turkeys thus skinned are processed into food.

3 Claims, 4 Drawing Figures

EXOTIC LEATHER, METHOD OF PROCESSING SAME, AND METHOD OF PROCESSING DOMESTIC FOWL

BACKGROUND OF THE INVENTION

Exotic leather is distinctly different from leathers generally used in shoes, boots, bags, garments, and accessory items. Such leather is usually cowhide, calfskin, kidskin, sheepskin, and goatskins. All of the aforementioned are domestic animals. Conversely, "exotic" leathers, as they are known in the trade, are not made from domestic animal hides or skins. According to definition, an exotic leather often comes from another country; is not native to the place where found; foreign; outlandish; alien; strikingly unusual in color or design, rich; showy; and is often elaborate.

The following are skins often produced that are known as exotics in the trade:

- American Alligator (*Alligator Mississipiensis*)
- New Guinea Crocodile (*Crocodylus Porosus* and *Crocodylus Novaguineae*)
- South American Alligator (*Caiman Crocodylus Fuscus*)
- Argentine Lizard (*Tupinambis Nigropunctatus*)
- Python (*Tython Reticulatus*)
- Southern Anaconda, Anaconda Sucurry Sucurujuba (*Eunectes Murinus* and *Eunectes Notaeus*)
- Hornback-Caiman Lizard (*Dracaena Guianensis*)
- Common Iguana Lizard (Iguana Spp.)
- Javanese Wart Snake-Karung (*Acrochordus Javanicus*)
- Indian Rat Snake-Whip Snake (*Ptyas Mucosus* and *Ptyas Korros*)

BRIEF DESCRIPTION OF THE INVENTION

It has been found that the domestic turkey skins and the like, may be processed and marketed as exotic leather for use primarily in the boot, shoe, and handbag industries. There has long been a concern over the continuing availability in sufficient volume of the exotic skins. The invention concerns a specie of animal native to the United States meeting the basic criteria of an exotic leather product for the boot, shoe, and handbag industry, and being available in sufficient quantities to satisfy the market. The turkey is a large bird which is raised solely for its meat value. Its availability numbers in the millions. Unexpectedly, it was found that the folicles holding the feathers are arranged in areas or patterns and that such areas contain patterns or designs. It was further found that by subjecting the turkey hide to substantial shrinkage, then such patterns may be emphasized so as to create an "exotic" leather within the meaning of the marketplace.

Thus, the concept of taking a domestic, meat producing bird, and developing an entirely new use for a nonnecessary part thereof (the skin) into an exotic leather product for the boot, shoe, and handbag industry has come into being.

Unexpectedly, it was found necessary to acquire the entire skin or hide with the feathers intact to avoid damaging the skin. Subsequently, the feathers are removed chemically and at that point a totally unexpected result; i.e., a built-in geometric design was discovered and fixed in raised pattern which in the case of fancy cowboy boots and the like, may be utilized by highly skilled individuals in the boot, shoe and handbag trade. This is in contrast to defeathering such as described and illustrated in U.S. Pat. No. 2,017,648. This natural design when raised and processed into the leather also carries over for use into shoes, handbags, and other items as well. Without stretching the imagination, the natural design or pattern on the turkey skin, going back to the dictionary's description of exotic, qualifies as, strikingly out of the ordinary; strikingly unusual in design; and showy.

With respect to the environment, all other exotic leathers may eventually be barred from harvesting by worldwide legislative efforts of various environmental groups, both within and outside official government circles. Thus, the utilization of the turkey skin or hide, a by-product of a domestic animal raised for its food value, would have a zero effect upon the environment. The removal of the feathers from the turkey skin revealed the unexpected design.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
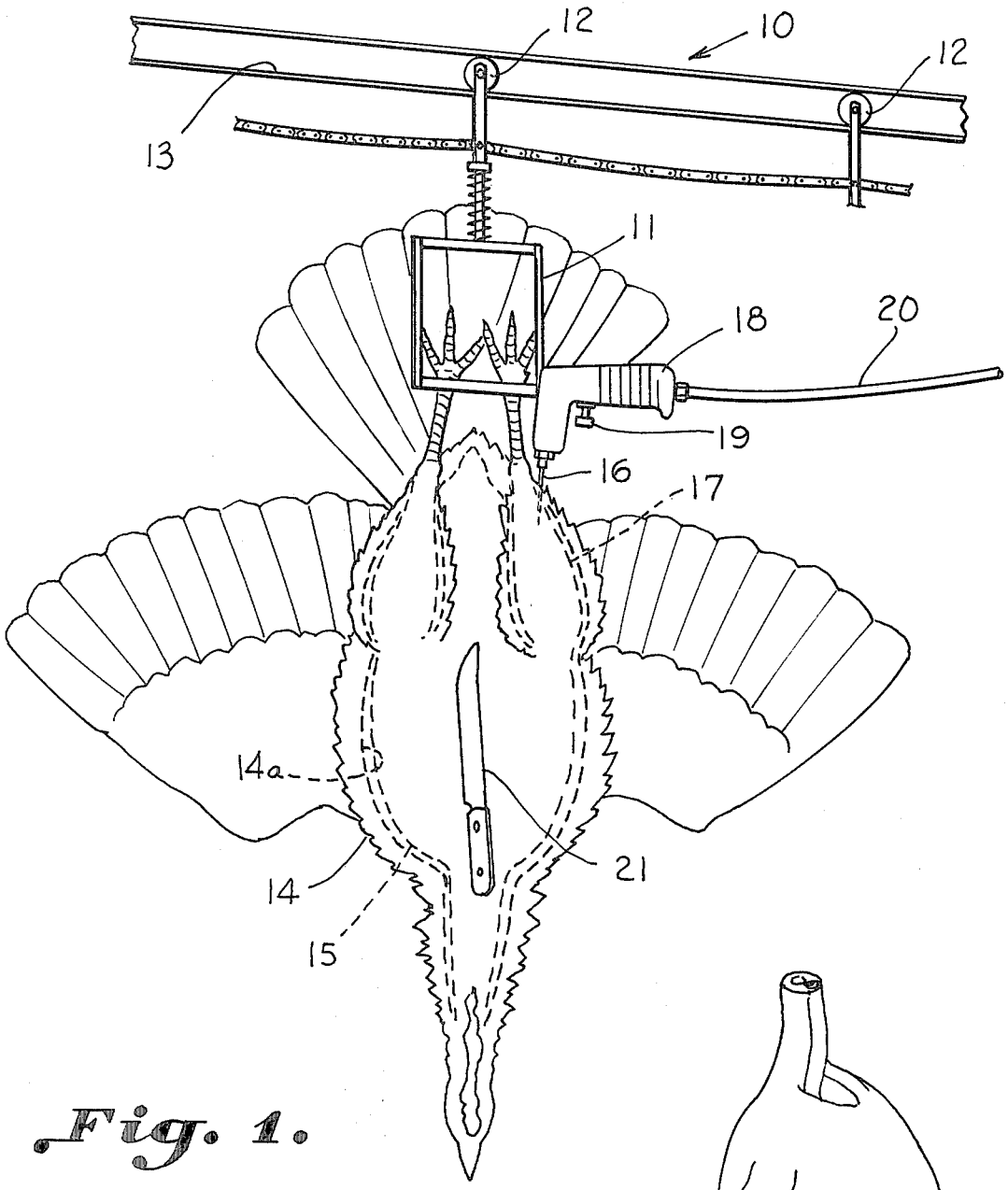
FIG. 1 is a schematic front elevation illustrating domestic turkey in shackles on a processing line with the bird facing underside forward.

FIG. 1 illustrates a processing line including a conveyor broadly designated at 10. The conveyor has shackles 11 carried on rollers 12 which ride upon a rail 13. The fowl is illustrated in FIG. 1 as having skin and feathers 14 and being processed in accordance with a preferred method hereof separating the skin with feathers from the body of the bird. The skin and feathers 14 is separated from the body portion illustrated in broken lines at 15 creating a space **14*a* therebetween. To accomplish this, a hyperdermic needle 16 is inserted beneath the skin adjacent the lower portion of the legs or drumstick portion 17. The hyperdermic needle is carried by a suitable air gun 18 which has a valve 19 for opening and closing the hyperdermic needle to a supply of compressed air passing through the hose 20. A knife blade 21** is illustrated for cutting the skin in a rip cut either down the back or down the belly.

Figure 2:
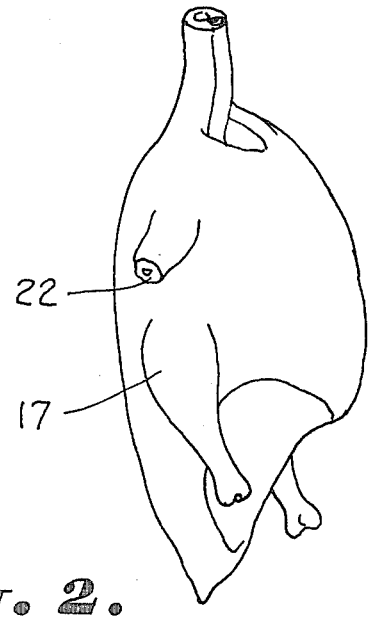
FIG. 2 is a perspective view side elevation illustrating a domestic turkey, having been skinned by utilization of the knife and air gun shown in FIG. 1.

It will be observed by reference to FIG. 2, that the wing cut is at the first joint as illustrated at 22 and the legs are removed at the customary portion in relation to the drumsticks 17. The skin with feathers thereon has been removed in FIG. 2.

Figure 4:
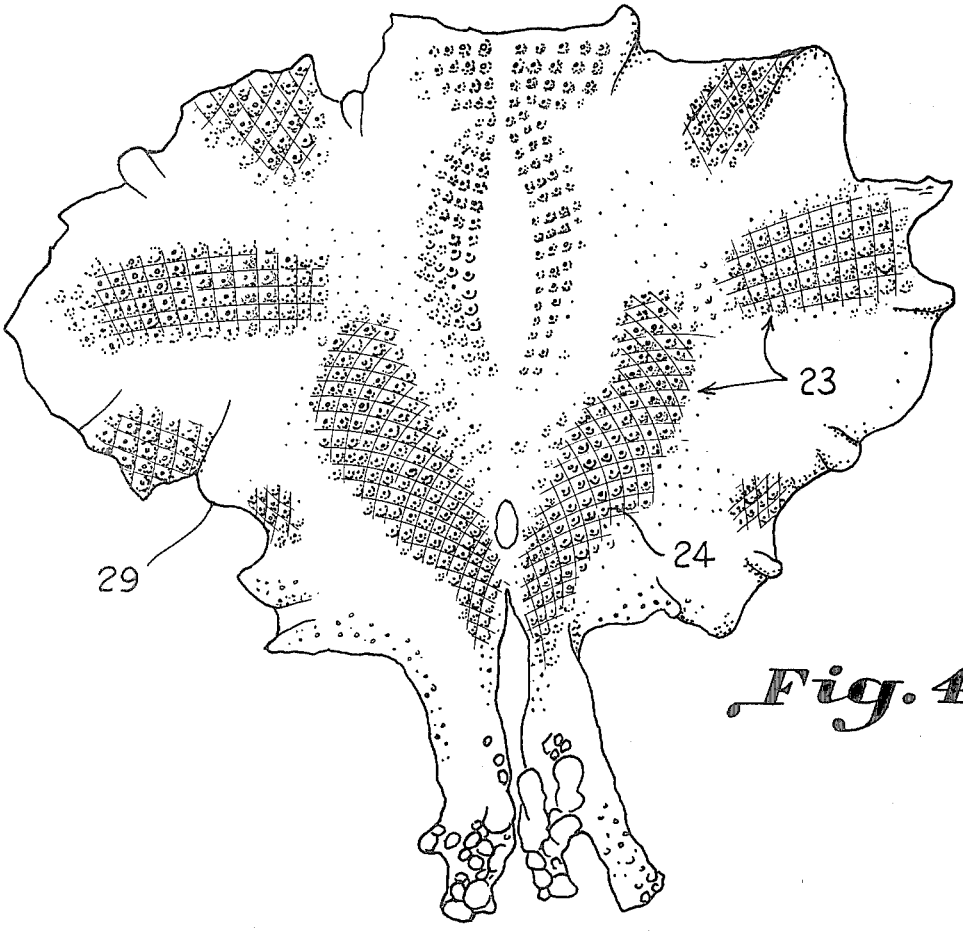
FIG. 4 is a top plan view illustrating leather processed from a turkey having been back-cut.
Figure 3:
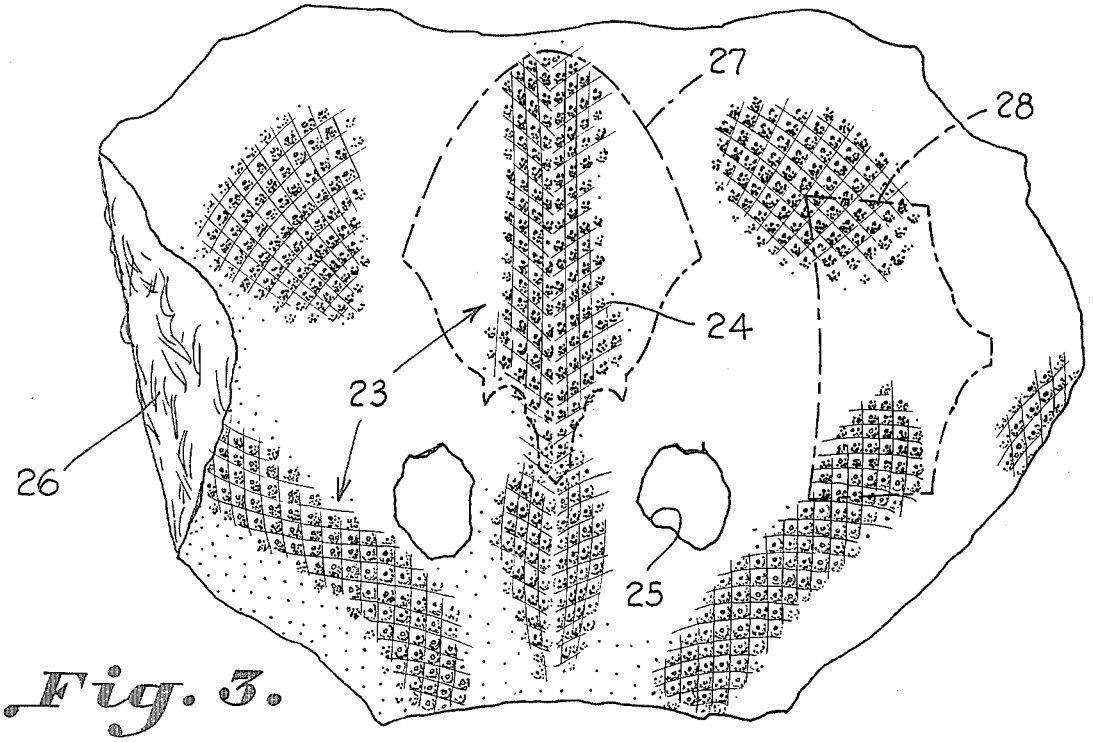
FIG. 3 is a top plan view illustrating turkey leather and pattern preparatory to making boots from the leather, such skin having been belly-cut.

FIGS. 3 and 4 best illustrate the pattern within a pattern formed by the puckered or follicle portions of the turkey skin after the feathers have been removed. Patterned areas are illustrated broadly as at 23, whereas geometric patterns are formed by sequences of puckered portion 24 as illustrated in the outer surface of the hide or skin in FIGS. 3 and 4. It will be observed that the holes formed by the wings are shown prominently in FIG. 3 as at 25. A certain amount of the flesh 26 remains when the skin is removed and treated as described above and illustrated in FIG. 3. A vamp pattern is illustrated in FIG. 3 in broken lines at 27 whereas heel counters are illustrated in broken lines as at 28. Both belly cuts and back cuts are satisfactory for most purposes such as boots, as illustrated in FIGS. 3 and 4, respectively, but it will be observed in FIG. 4 that the patterns will be different and the wings opening portions 29 in FIG. 4 are adjacent the marginal portions of the skin.

The current method of treating domestic fowl may be described as follows. The first step is the stunning of the bird electrically. The jugular vein in the neck is then cut to induce thorough bleeding and dispatch the bird. The entire carcass is then dipped in 140 degrees Fahrenheit water for approximately three minutes to free up the feathers. The bird is then thoroughly plucked. The entrail cavity is then cleaned, entering through the neck and anal area. When the turkey meat is to be sold in parts, it is then cut up into appropriate pieces. The skin is also removed in pieces during this procedure. The flesh is cooled, then flash frozen. The skin is often utilized as a gelatin binder for the meat by the canners of turkey loaf. When used in making soup it may be desirable to remove the skin with the considerable fat contained therein.

According to the invention, after stunning and bleeding the carcass is skinned as described above without removing the feathers. Care must be exercised to avoid cutting or tearing the skin during its removal. Using compressed air while knifing off the skin facilitates skinning. The skin must be removed whole, with the ripping cut down the back, or the belly as required by market demand. Following removal of the whole skin with the feathers on, the flesh side must be salted promptly with half ground medium course salt. The skin with the feathers on, must then be placed in cold storage for approximately three weeks. This procedure is to aid in the breakdown of the fat cells in the skin or hide. This fat cell breakdown is a very necessary part of the tanning process. Cold storage temperature may be approximately 400 degrees.

It is further known, for example, that ostriches are exclusively back-flayed, i.e., the ripping cut is made on the underside, since the feather follicles or quill holes which give the leather its characteristic random grain are most prominent on the dorsal skin. The quill holes are not evenly distributed over the entire area of the ostrich skin, as is the case with penguin skins, but are arranged in the shape of a bulging flask, which is widest at a level with the insertion of the thighs and tapers quite sharply towards the anus.

From the tanner's point of view, the skins obtained from farm ostriches are the most valuable because they are seldom damaged by thorn scratches and are well flayed and preserved. Preservation by air-drying is not recommended, since dried ostrich skins do not swell sufficiently when soaked back and cannot be restored to their original condition. This considerably impairs their quality. The only method that can be safely recommended for this purpose is wet-salting.

The very greasy ostrich and penguin skins should be soaked in a liquor containing solvent-based anionic wetting agents and detergents to remove enough of the natural fat for the liming chemicals to be able to attack the skin. To assist the degreasing effect mechanically, the skins are lightly machine-fleshed after the first day of soaking and then put back into the same soaking liquor for one more day.

Liming in a sodium hydrogen sulphide, sodium sulphide lime liquor in slowly rotating drums had proved most effective. The skins are first drummed in a short float with 3–4 percent sodium hydrogen sulphide; after one hour 2–4 percent sodium sulphide is added, followed after another hour by 4–6 percent lime. The duration of the liming process should not exceed three days.

The bating process is of particular importance in the processing of bird skins, especially if the bating materials contain fat-splitting enzymes lipases as well as proteases. Lipases sponify and triglyceride fats in the pelts, if they have not already been saponified during liming, and additionally emulsify a considerable portion of the cholesterol-type fats which are difficult to saponify. Bating also brings about the least particle splitting of the lime soaps present in the skins after liming.

Fat laid down in the subcutaneous tissue of bird skins often migrates while the skins are kept in storage. This fat must be extracted with petroleum solvent and an emulsifier before the skins can be tanned to prevent the formation of chromium soaps. The importance of this process cannot be emphasized too strongly because careful bating has an even more decisive effect on the quality of leather manufactured from bird skins than from sheep or pig skins.

The large quantities of fat, which are unevenly distributed throughout the skin, reduce wettability and thereby impair the intensity and the levelness of all the limehouse operations and tanning. When the skins are placed in the chrome tanning liquor in this condition, the high content of unevenly distributed fat in the skin causes the formation of chromium soaps which are impossible to remove.

To enhance the degreasing effect, a bleaching pickle is carried out with chemicals which split off chlorine dioxide. The natural fat is first chlorinated and its unsaturated components are oxidized. The resultant chlorinated or oxidized fats can then be fairly easily dissolved out of the skins so that they cannot interfere with subsequent chrome tannage. The skins are drum-tanned with 2.6 percent chromium oxide. According to the desired color, the skins are retained either with vegetable or synthetic tanning agents.

The bird skins should be given a preliminary fatliquoring with synthetic products which undergo firm linkage with the leather fiber, are free from harmful fatty acids and act as solvents for natural fats. In this way fatty sput can be prevented on finished ostrich and penguin leathers. White spirit has proved most suitable for this purpose because the leathers are very soft after this treatment and require scarcely any subsequent fatliquoring. The reason may be that the hydroxyfatty acids released by the splitting of glycerides are not removed from the leather but instead rather tend to produce the effect of a light oil tannage.

On the other hand, failure to remove enough of these hydroxyfatty acids is the reason why degreasing bird skins with white spirit is often unsuccessful. An addition of methyl alcohol to the degreasing bath enhances the wetting power of the white spirit. At the same time the fatty acids are induced by the alcohol to go into the solution, while they may fail to dissolve into pure white spirit. After degreasing, the leathers are sorted weighed and dyed.

After dyeing, the leathers are horsed up for several hours (10–12 hours) and stretched without sammying. The flesh side is then cleaned on a fluffing machine. The skin is laid with the flesh side downwards on the fluffing cylinder and held firm by the operator leaning against the machine housing. The leather is then pressed down onto the rotating cylinder hand with a hand leather or a soft brush. The operator's hand should remain in constant motion to prevent the skin from scorching. Fluffing and grinding machines have the disadvantage that the progress of buffing cannot be constantly observed and that to check the effect the skin has to be constantly turned over.

After the leathers have been freed from buffing dust and loose leather fibers, they are given a bottom coat of a finishing solution based on thermoplastic binders and containing 40–60/1 pigment. This pigment content should not exceed this level since its purpose is to level up the natural color of the leathers and not to obliterate the character of their grain.

The leathers are dried, given a final coat of repolishable nitrocellulose finish solution and then milled for 3–4 hours. After they have been measured on an area measuring machine, the leathers are ready for dispatch. Unlike penguin skins, ostrich skins cannot be finished on a spraying machine.

Turkey skin processing may include the steps generally described above in connection with ostriches. By way of further detailed description, following the slaughter of domestic birds such as turkeys, as described above, the skin may be removed in the following manner.

The lower leg is removed up to where the feathers begin. The wings are removed to the shoulder. The outer skin is slit from the neck down the belly to the anal opening or the reverse from the neck down the back to the anal opening. The entire skin is removed intact by pulling and/or cutting with the features remaining on the skin. Once the skin is removed and as soon as practical, it is salted with coarse grain salt and stored under refrigeration at approximately 40 degrees until shipped to processor.

It should be noted by way of contrast, in the course of curing a bird skin for taxidermy purposes, it is important to remove the skin from a bird with the entire skin intact. When such a specimen is processed, a combination of curing agents are used to preserve the skin following careful hand scraping of the internal cavity. Generally the bird is immersed in a solution of formaldehyde, alum, and salt in the process. Feather retention is an important part of the overall finished product.

It should be noted in taxidermy, the emphasis on treatment of the skin is just to cure the skin and prevent deterioration. There is no concern with the appearance or natural design of the skin, the fashion uses, or the wearing strength of the skin. The skin is incidental to holding the feathers and reshaping the body for mounting.

In processing the turkey skin into an exotic leather, an entirely different process is required as it is necessary to dissolve the feathers chemically in order to avoid any damage to the very fragile skin. Following the removal of the feathers, the tanning process applied to the skin which is the basic tannage used on exotic skins as described above in connection with ostriches; which are sometimes utilized in the boot and shoe trade. This process consists of developing a firm, durable, supple, and attractive leather with the fibers arranged chemically, then dyed and finished so as to enhance the natural configurations and characteristics of the skin with total emphasis on the development of the geometric pattern thereon.

In the processing of ostriches, the puckered portions are formed largely by repeatedly plucking the bird live for its highly sought after plumage so that blood clots emphasize and tend to close the follicle openings. It is important to note that in the preparation of turkey hides into exotic leather that the bird is skinned with the feathers on. The puckers are formed as a result of shrinkage which is far more extensive than that carried out on ostrich skins and is carried out to the extent necessary to achieve the desired pucker.

While a preferred embodiment of the invention has been described using specific terms, such description is for illustrative purposes only, and it is to be understood that changes and variations may be made without departing from the spirit or scope of the following claims.

What is claimed is:

1. The method of preparing exotic leather from skin and adjacent flesh of a domestic fowl comprising the steps of:

storing the skin and adjacent flesh in cold storage;

removing the feathers from the skin and adjacent flesh;

degreasing the skin and adjacent flesh;

subjecting the skin and adjacent flesh to shrinkage; and tanning the skin and adjacent flesh;

whereby a domestic fowl is processed for food while the skin and adjacent flesh produce an exotic leather.

2. An exotic leather comprising: a skin portion from a domestic fowl having been subjected to degreasing and shrinking sufficient to close and pucker the follicle portions after removal of the feathers, said skin portion having been tanned after said degreasing, and said leather possessing a pattern within a pattern constituted by said follicle portions having been puckered.

3. An exotic leather comprising: a turkey skin portion having been subjected to degreasing and extensive shrinking in order to close and pucker the follicle portions after removal of the feathers, said skin portion having been tanned, and said leather possessing a pattern within a pattern constituted by said follicle portions have been puckered.

* * * * *